United States Patent [19]

Suzuki et al.

[11] 4,110,169

[45] Aug. 29, 1978

[54] METHOD FOR MANUFACTURING HIGH-STRENGTH FORMED COKE IN SLIGHT MUTUAL AGGLOMERATION USING HORIZONTAL TYPE COKE OVEN BATTERY

[75] Inventors: Gyoichi Suzuki, Tokyo; Sanseki Moriguchi, Yokohama; Takashi Miyazu, Tokyo; Yasuo Okuyama, Yokohama; Masahiro Muroya, Yokohama; Mamoru Yanagiuchi, Yokohama; Takashi Mori, Yokohama; Mitsutoshi Miura, Yokohama, all of Japan

[73] Assignee: Nippon Kokan Kabushiki Kaisha, Tokyo, Japan

[21] Appl. No.: 839,897

[22] Filed: Oct. 6, 1977

Related U.S. Application Data

[63] Continuation-in-part of Ser. No. 665,051, Mar. 8, 1976, abandoned.

[30] Foreign Application Priority Data

Apr. 1, 1975 [JP] Japan ..... 50-38562

[51] Int. Cl.[2] ..... C10B 53/08; C10B 57/04

[52] U.S. Cl. ..... 201/6; 201/8; 201/23; 201/24; 201/42

[58] Field of Search ..... 201/3, 6, 8, 5, 24, 201/21, 23, 42; 44/10 K, 10 H, 14; 202/138

[56] References Cited

U.S. PATENT DOCUMENTS

| | | | |
|---|---|---|---|
| 1,443,618 | 1/1923 | Daineo | 44/25 |
| 2,933,378 | 4/1960 | Mustin et al. | 44/14 |
| 3,091,012 | 5/1963 | Bell | 44/14 X |
| 3,444,047 | 5/1969 | Wilde | 201/6 |
| 3,663,186 | 5/1972 | Dzhapuridze et al. | 44/10 H |
| 3,883,399 | 5/1975 | Nire | 201/6 |
| 3,907,648 | 9/1975 | Nire et al. | 201/6 |

FOREIGN PATENT DOCUMENTS

| | | |
|---|---|---|
| 2,174,076 | 10/1973 | France. |
| 1,195,232 | 11/1959 | France. |
| 869,627 | 2/1942 | France. |
| 495,624 | 4/1930 | Fed. Rep. of Germany. |

OTHER PUBLICATIONS

Petrographic & Dilatation Studies of Inert Additives to Coking Coal Blends; Nandi et al.; Fuels Research Centre, Div. Report.

ASTM Test, D 2797-72, pp. 551-559, Preparing Coal Samples for Microscopical Analyses by Reflected Light.

*Primary Examiner*—Morris O. Wolk
*Assistant Examiner*—Michael S. Marcus
*Attorney, Agent, or Firm*—Flynn & Frishauf

[57] ABSTRACT

A plurality of different types of raw material coal fines are sieved to a size not exceeding 1.5 mm; said sieved raw material coal fines are blended so as to satisfy the following conditions:

(a) AP index: 75 at the minimum, (b) Mean maximum reflectance: 1.20% at the minimum, and (c) A [dilatation] − [contraction] value of from −2 to +5% when carbonized under conventional conditions in a horizontal type coke oven battery at a heating rate of 5° C/min. (350° - 600° C);

said blended raw material coal fines thus obtained are mixed with a binder and formed to produce a formed coal; and then, said formed coal thus obtained is charged into a horizontal type coke oven battery and carbonized, whereby a high-strength formed coke for blast furnace is a slight mutual agglomeration is manufactured.

2 Claims, 5 Drawing Figures

METHOD FOR MANUFACTURING HIGH-STRENGTH FORMED COKE IN SLIGHT MUTUAL AGGLOMERATION USING HORIZONTAL TYPE COKE OVEN BATTERY

RELATED APPLICATION

This application is a continuation-in-part of our application Ser. No. 665,051, filed Mar. 8, 1976, now abandoned.

FIELD OF THE INVENTION

The present invention relates to an improvement in the method for manufacturing a high-strength formed coke for blast furnace in a slight mutual agglomeration using a horizontal type coke oven battery.

BACKGROUND OF THE INVENTION

For the purpose of improving the coke quality and the productivity, in manufacturing a coke for blast furnace using a conventional, i.e., a horizontal type coke oven battery, a method is known, which comprises charging briquettes produced by forming blended raw material coal fines by a compression forming machine (hereinafter referred to as "formed coal"), and carbonizing said formed coal to produce a coke.

According to this method, a coke for blast furnace is produced either by charging a formed coal and coal fines after mixing into a horizontal type coke oven battery, charging a formed coal and coal fines alternately in horizontal layers into a horizontal type coke oven battery, or charging a formed coal only into a horizontal type coke oven battery; and then carbonizing the raw materials thus charged.

In the aforementioned method, in charging a formed coal and coal fines in combination into a horizontal type coke oven battery, pieces of formed coal should be completely agglomerated with surrounding coal fines during the process of carbonization. For this purpose, it is necessary to use raw material coals having a somewhat high fluidity in carbonizing, and this not only imposes certain limits on the range of selection and blending of raw material coals used, but also necessitates troublesome charging practices into the horizontal type coke oven battery.

When only a formed coal is charged into a horizontal type coke oven battery, there is available a wide range of selection and blending of raw material coals used, and the charging into a horizontal type coke oven battery is also easy. In this case, however, the operation of the horizontal type coke oven battery is problematic. More specifically, with a view to facilitating discharge of an already carbonized formed coal (hereinafter referred to as "formed coke"), it is necessary that pieces of formed coke should be mutually agglomerated. On the other hand, however, a formed coke mutually agglomerated too firmly remains in the agglomerated state even after discharging, not separated into pieces. It is therefore desirable that a formed coke produced by charging only a formed coal into a horizontal type coke oven battery, being in a mutually agglomerated state at the time of discharging, should be only slightly agglomerated so as to permit easy separation into pieces after discharging. In a horizontal type coke oven battery, however, the heating rate differs between the zone near the oven walls and the central zone. If the blending ratio of raw material coals is decided on the basis of the central zone, pieces of formed coke in the zone near the oven walls are mutually agglomerated too firmly, and remain in the agglomerated state even after discharging, not permitting separation into pieces. A blending ratio of raw material coals not causing mutual agglomeration of a formed coke, if adopted to avoid the aforementioned drawback, leads to a lower strength of the formed coke. If, on the contrary, the blending ratio of raw material coals is decided on the basis of the zone near the oven walls, pieces of formed coke in the central zone are not mutually agglomerated, thus making it difficult to discharge the produced coke.

For the purpose of obtaining a formed coke in mutual agglomeration as mentioned above, a method has been proposed, which comprises charging only a formed coal produced by blending raw material coal fines so as to give a coking index of 80 to 88 into a horizontal type coke oven battery and carbonizing said formed coal. According to this method, it is not always possible to obtain a satisfactory formed coke in a slight mutual agglomeration. Said coking index is defined as an index calculated by $(A + B/10 \times 100$, where:

A: The amount of oversize coke (g) obtained by sieving through a 35 mesh screen a coke produced through carbonization of a mixture consisting of a coal fine with a size of not more than 65 mesh in an amount of 1 g and a coke breeze with a size of 48 to 65 mesh in an amount of 9 g in a crucible at 950° ± 20° C for 7 minutes; and B: The amount of oversize coke (g) obtained by sieving further through a 48 mesh screen the undersize coke obtained through said 35 mesh screen.

SUMMARY OF THE INVENTION

An object of the present invention is therefore to provide an improvement in a method for manufacturing a high-strength formed coke for blast furnace in a slight mutual agglomeration using only a formed coal comprising low-grade raw material coals in a horizontal type coke oven battery.

In accordance with one of the features of the present invention, there is provided an improvement in a method for manufacturing a high-strength formed coke in a slight mutual agglomeration solely from formed coal in a conventional horizontal type coke oven battery, which comprises sieving a plurality of different types of raw material coal fines to a size not exceeding 1.5 mm., mixing said plurality of different types of raw material coal fines thus sieved with a binder, forming same to produce a formed coal, charging only said formed coal into said coke oven battery, and then, carbonizing said formed coal in said coke oven battery under conventionl carbonizing conditions to produce a formed coke, said improvement being characterized by: blending said plurality of different types of coal fines after said sieving step to form a mixture of coal fines so as to satisfy the following conditions:

(a) AP index: 75 at the minimum, (b) Mean maximum reflectance: 1.20 % at the minimum, and (c) A [dilatation] − [contraction] value of from −2 % to +5 % when carbonized under conventional conditions in said coke oven battery at a heating rate of 5° C/min. (350°- 600° C);

whereby said formed ccoke has a percentage of co-agglomeration within a range of from 40 to 90 %.

DETAILED DESCRIPTION OF PREFERRED EMBODIMENTS

We have conducted an intensive study of the method for manufacturing a formed coke using a conventional, i.e., a horizontal type coke oven battery, and found as a result the possibility of obtaining a high-strength formed coke for blast furnace in a slight mutual agglomeration by: sieving a plurality of different types of raw material coal fines to a size not exceeding 1.5 mm; blending said raw material coal fines thus sieved so as to satisfy the following conditions:

(a) AP index: 75 at the minimum,
(b) Mean maximum reflectance: 1.20 % at the minimum, and
(c) A [dilatation] — [contraction] value of from −2 to +5 % when carbonized under conventional conditions in said coke oven battery at a heating rate of 5° C/min. (350° - 600° C);

mixing said blended raw material coal fines thus obtained with a binder, forming same in a compression forming machine to produce a formed coal; charging only said formed coal thus obtained into said coke oven battery; and then carbonizing same, said formed coal in said coke oven battery under conventional carburizing conditions to produce a formed coke.

Figure 1:
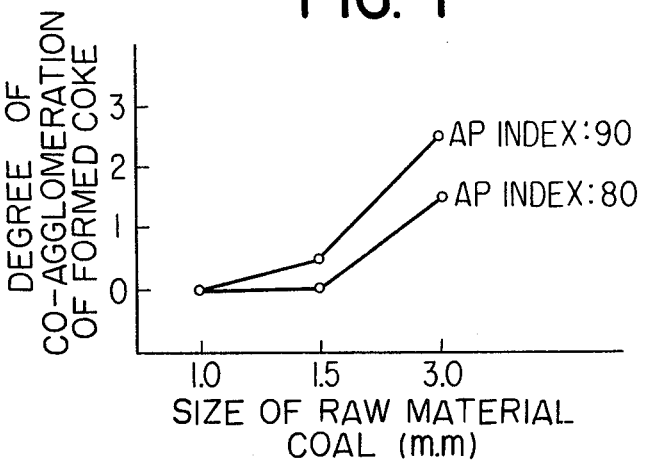
FIG. 1 is a graph illustrating the relation between the size of raw material coal fines for formed coal and the degree of co-agglomeration of a formed coke.

In the present invention, the size of blended raw material coal fines for formed coal is limited to 1.5 mm and below in view of the relation between the size of blended raw material coal fines and the degree of co-agglomeration of formed coke shown in FIG. 1. The degree of co-agglomeration as herein employed is defined as an index representing the degree of mutual agglomeration between pieces of formed coke, as expressed by 3 in the case where, in carbonizing only a formed coal into a formed coke, the pieces of formed coke are mutually agglomrated firmly and a force applied to separate pieces of said formed coke would result, not in the separation at agglomeration interfaces, but in the breakout of individual pieces of the formed coke, and by 0 in the case where the pieces of formed coke mutually agglomerated are separated at agglomeration interfaces by the application of a relatively small force. FIGS. 1.0, 1.5 and 3.0 indicated on the abscissa of FIG. 1 mean that the size of the blended raw material coal fines does not exceed 1.0 mm, 1.5 mm and 3.0 mm, respectively.

As mentioned above, both a too firm mutual agglomeration and the non-mutual-agglomeration are not desirable for a formed coke. Said degree of co-agglomeration is preferably under 1, and more preferably 0. In the present invention, a degree of co-agglomeration of this order is referred to as a slight co-agglomeration. As is clear from FIG. 1, in terms of the AP index described later, a size of raw material coal fines not exceeding 1.5 mm leads to a degree of co-agglomeration of formed coke of as low as under 1 or even 0 in most cases, thus leading to a desirable slight co-agglomeration of a formed coke.

Figure 2:
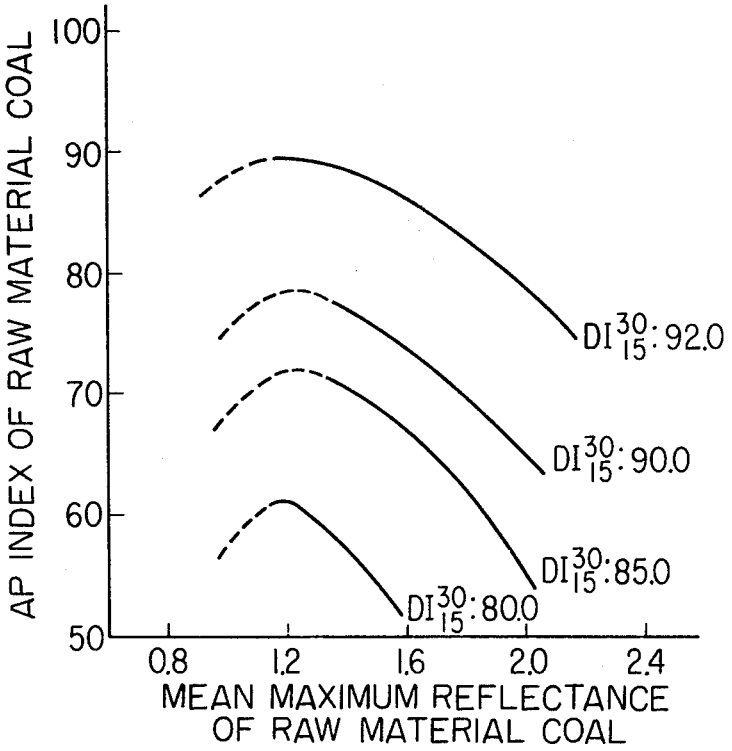
FIG. 2 is a graph illustrating, in terms of the coke strength, the relation between the mean maximum reflectance and the AP index of blended raw material coal fines.

Also in the present invention, the AP index is limited to 75 at the minimum, and the mean maximum reflectance, to 1.20 % at the minimum, in view of the relation between the mean maximum reflectance and the AP index of blended raw material coal fines, shown in FIG. 2 with regard to the strength $DI_{15}^{30}$ of a formed coke.

The AP index, an abbreviation of the Agglomeration Property Index, of blended raw material coal fines, herein employed, is defined as a percentage obtained by: crushing a coal sample in an amount of 35 g to a size not exceeding 1 mm; producing a formed coal by adding a 10 wt. % binder and by forming the mixture in a compression forming machine under a pressure of 300 kg/cm$^2$; charging said formed coal in an experimental coke oven at an oven temperature of 500° C and carbonizing same to a final temperature of 900° C to produce a formed coke in a briquette form; puttinhg the formed coke thus obtained into a small-sized drum (200 mm dia. × 70 mm long, 50 r.p.m.); after turning said drum 1,000 times, sieving said formed coke through a 3 mm screen; and calculating the ratio of the oversize coke weight to the formed coke weight before sieving. This AP index has been created by the inventors. The mean maximum reflectance is obtained by: crushing a coal sample to a size not exceeding 20 mesh; freezing the crushed coal sample with an acrylic resin and polishing same; and measuring the reflectance of light of the vitrinite in an oil in compliance with ASTM-2797-69T and 2798-69T.

It is in general desirable that a coke for blast furnance should have a coke strength $DI_{15}^{30}$ of at least 92.0. As is evident from FIG. 2, a formed coke having a coke strength $DI_{15}^{30}$ of at least 92.0 is obtained only when using a formed coal produced from blended raw material coal fines having an AP index of at least 75 and a mean maximum reflectance of at least 1.20%. The results of measurement shown in FIG. 2 refer to a case where a formed coke was produced by carbonizing a formed coal under the following conditions:

Size of blended raw material coal fines: 1.5 mm at the maximum,
Amount of binder: 10 wt.% (C/H: 0.72), and
Heating rate: 5.5° C/min. (400° - 600° C).

Figure 3:
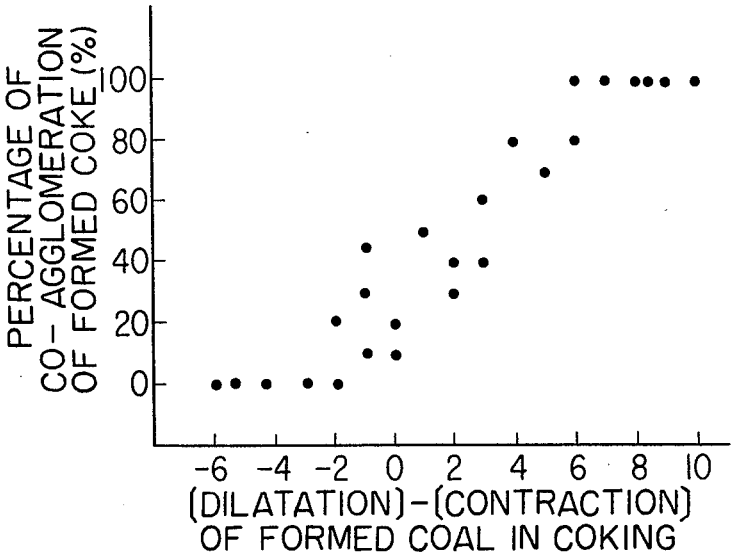
FIG. 3 is a graph illustrating the relation between the [dilatation] — [contraction] value of a formed coal when carbonized at a heating rate of 5° C per minute and the percentage of co-agglomeration of a formed coke.

In the present invention, furthermore, the [dilatation] — [contraction] value of a formed coal when carbonized under conventional conditions in a horizontal type coke oven battery at a heating rate of 5° C/min. (350 — 600° C) is limited to a range of from −2 to +5%, in view of the relation between the [dilatation] — [contraction] value of a formed coal when carbonized and the percentage of co-agglomeration of a formed coke shown in FIG. 3. The percentage of co-agglomeration herein employed is defined as a percentage representing the state of mutual agglomeration between pieces of a formed coke produced by carbonizing only a formed coal, with 100% for the case in which all the pieces of formed coke are mutually agglomerated, and with 0% for the case with no mutual agglomeration between the pieces of formed coke. The [dilatation] – [contraction] value in the present invention is measured in accordance with DIN-51739, except only that the heating rate in the present invention is 5° C per minute whereas 3° C per minute in DIN-51739.

As mentioned above, pieces of a formed coke should preferably be in a slight mutual agglomeration, and a formed coke in this preferable slight mutual agglomeration is obtained when said percentage of co-agglomeration is within the range of from 40 to 90%. In other words, a formed coke with a degree of co-agglomeration of under 1 or more preferably of 0 is obtained when said percentage of co-agglomeration is within the range from 40 to 90%. As is clear from FIG. 3, when using a formed coal with a [dilatation] – [contraction] value in the range from −2 to +5% when carbonized, the percentage of co-agglomeration of formed coke lies within the range from 40 to 90%. The results of measurement shown in FIG. 3 refer to a case where a formed coke was produced by carbonizing a formed coke under the following conditions:

Size of blended raw material coal fines: 1.5 mm at the maximum,
Amount of binder: 10 wt. % (C/H: 0.72), and
Heating rate: 5.5° C/min. (350° - 600° C).

Figure 4:
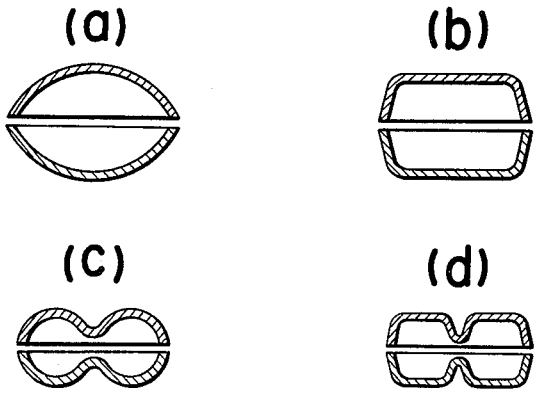
FIG. 4 (*a*) and (*b*) are sectional views of conventional molds used for producing a formed coal, and FIG. 4 (*c*) and (*d*), sectional views of more desirable molds in the present invention.
Figure 5:
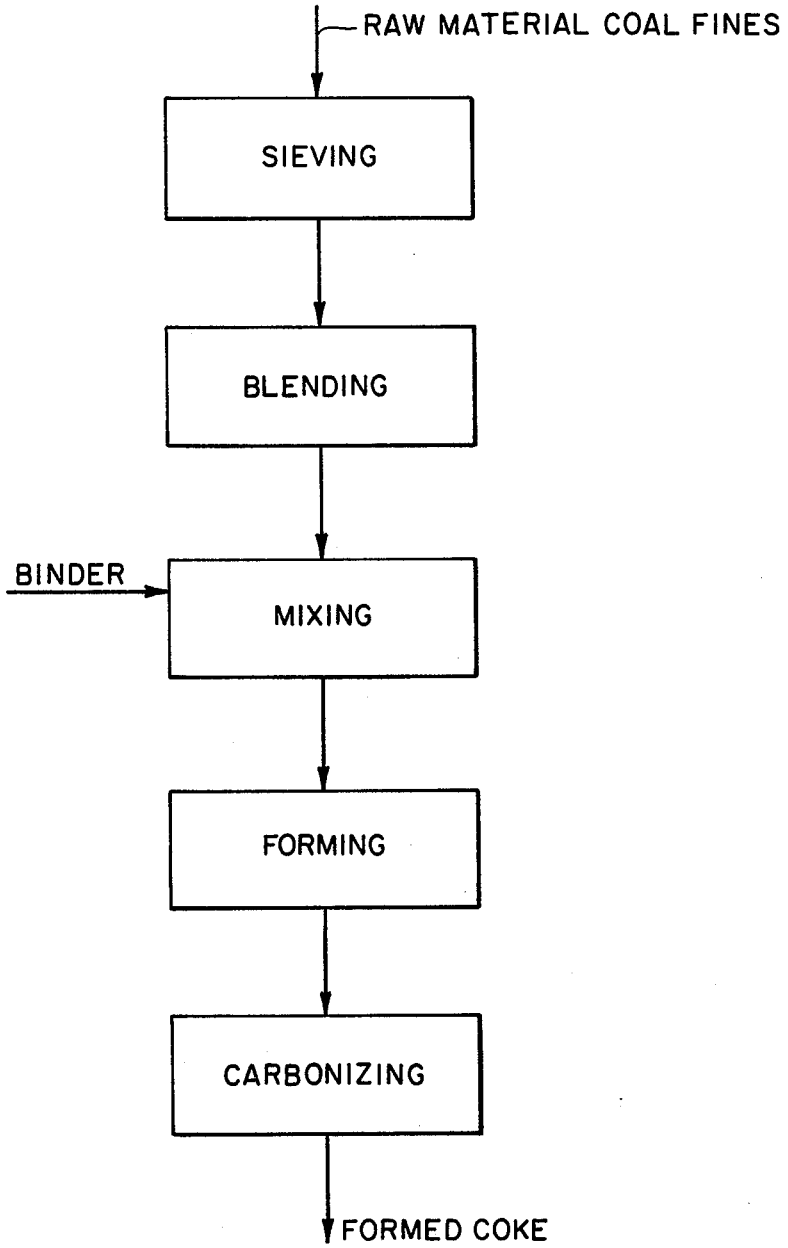
FIG. 5 is a flow chart of the process of this invention.

Usually, two semi-spherical molds as shown in the sectional views of FIG. 4(*a*) and (*b*) are conventionally employed for producing a formed coal. The possibility was however found to obtain the following favorable merits;

(1) Mechanical strength of a formed coal and a formed coke are not impaired;
(2) In a horizontal type coke oven battery, the larger contact area between pieces of a formed coke permits easier discharge of coke even with a low degree of co-agglomeration of the formed coke; and
(3) In charging a formed coke into a blast furnance, the permeability resistance is smaller than in a conventional formed coke. In addition, the more active convection heat conduction in carbonizing a formed coal in a horizontal type coke oven battery leads to a smaller difference in the carbonizing conditions in the oven width direction than in a conventional one, by using two molds having a ridge at the center as shown in the sectional views of FIG. 4(*c*) and (*d*), and by producing pieces of formed coal in the form of briquettes each having a groove on the upper and the lower surfaces, respectively.

Now, the present invention is described further in detail with reference to some embodiments.

EXAMPLE 1

Raw material coal fines having a size not exceeding 1.5 mm were blended as follows:

Black Water Coal: 20 wt.%
Big Ben Coal: 25 wt.%, and
Kuznetsk OS Coal: 55 wt.% to obtain blended raw material coal fines presenting an AP index of 90.0, a mean maximum reflectance of 1.35%, a [dilatation] – [contraction] value of +2% when carbonized at a heating rate of 5° C/min. (350° - 600° C), an ash content of 8.5 wt.% and a volatile matter content of 23.8 wt.%. Said blended raw material coal fines were mixed with a 10 wt.% binder and formed in a compression forming machine under a pressure of 300 kg/cm$^2$ to produce a formed coal. As said binder, propane-modified asphalt was used which usually has the following composition:

Ash: 0.07 - 0.09 wt.% (on dry base)
C: 84 - 86 wt.% (on dry ash-free base)
H: 10 - 11 wt.% (on dry ash-free base)
Total Sulfur: 4 - 5 wt.% (on dry base)

Said formed coal was charged into a horizontal type coke oven battery, and carbonized into a formed coke. Said formed coke thus obtained showed a coke strength $DI_{15}^{30}$ of 92.0 and was in a very good slight mutual agglomeration with a degree of co-agglomeraton of 0.

EXAMPLE 2

Raw material coal fines with a size not exceeding 1.5 mm were blended as follows:

Black Water Coal: 20 wt.%,
Sprague MH Coal: 25 wt.%,
Watson Coal: 15 wt.%,
Kuzunetsk OS Coal: 30 wt.%, and
Delayed Type of Petroleum Coke: 10 wt.% to obtain blended raw material coal fines having an AP index of 87.7, a mean maximum reflectance of 1.49%, a [dilatation] – [contraction] value of +3% when carbonized at a heating rate of 5° C/min. (350° - 600° C) of 3%, an ash content of 11.4 wt.%, and a volatile matter content 21.4 wt.%. Then, a formed coal was produced in the same manner as in Example 1, and a formed coke was manufactured by carbonizing said formed coal. Said formed coke thus obtained showed a coke strength $DI_{15}^{30}$ of 92.3 and was in a very good slight mutual agglomeration with a degree of co-agglomeration of 0.

According to the present invention, as described in detail above, it is possible to manufacture a formed coke having a coke strength necessary for blast furnace and in slight mutual agglomeration to a desirable extent, in a horizaontal type coke oven battery, from low-grade raw material coal fines, thus providing industrially useful effects.

What is claimed is:

1. In a method for manufacturing a high-strenght formed coke in a slight mutual agglomeration solely from formed coal in a conventional horizontal type coke oven battery, which comprises sieving a plurality of different types of raw material coal fines to a size not exceeding 1.5 mm., mixing said plurality of different types of raw material coal fines thus sieved with a binder, forming same to produce a formed coal, charging only said formed coal into said coke oven battery, and then carbonizing said formed coal in said coke oven battery under conventional carburizing conditions to produce a formed coke, the improvement characterized by:

blending said plurality of different types of coal fines after said sieving step to form a mixture of coal fines so as to satisfy the following conditions:
(a) AP index: 75 at the minimum, (b) Mean maximum reflectance: 1.20% at the minimum, and (c) A [dilatation]-[contraction] value of from −2 to +5% when carbonized under conventional conditions in said coke oven battery at a heating rate of 5° C./min. (350° - 600° C.);

whereby said formed coke has a percentage of co-agglomeration within a range of from 40 to 90%.

2. The method claimed in claim 1, wherein said formed coal is formed into briquettes each having a groove on the upper and the lower surface thereof, respectively.

* * * * *